US005313773A

United States Patent [19]

Poquette et al.

[11] Patent Number: 5,313,773

[45] Date of Patent: May 24, 1994

[54] COATINGS FOR SPINNING APPLICATIONS AND RINGS AND TRAVELERS COATED THEREWITH

[75] Inventors: Gerry E. Poquette, Denver; Gary P. Groves, Gastonia, both of N.C.

[73] Assignee: A. B. Carter, Inc., Gastonia, N.C.

[21] Appl. No.: 903,361

[22] Filed: Jun. 24, 1992

[51] Int. Cl.[5] ..... D01H 7/52; D01H 7/62

[52] U.S. Cl. ..... 57/125; 57/75; 57/119; 57/120

[58] Field of Search ..... 57/75, 119, 120, 125; 428/704

[56] References Cited

U.S. PATENT DOCUMENTS

| | | | |
|---|---|---|---|
| 1,595,858 | 8/1926 | Crompton . | |
| 2,448,150 | 8/1948 | Mulholland . | |
| 2,831,313 | 4/1958 | Burns et al. . | |
| 2,970,425 | 2/1961 | Foard . | |
| 3,084,501 | 4/1963 | Kluttz . | |
| 3,226,924 | 1/1966 | Dalpiaz | 57/119 |
| 3,304,707 | 2/1967 | Kluttz | 57/120 |
| 3,387,447 | 6/1968 | Trammell et al. . | |
| 3,396,527 | 8/1968 | Joseph, Jr. et al. . | |
| 4,201,066 | 5/1980 | Nolan, Jr. . | |
| 4,360,161 | 11/1982 | Claxton et al. . | |
| 4,362,012 | 12/1982 | LeChatelier . | |
| 4,441,969 | 4/1984 | Tremmel . | |
| 4,450,051 | 5/1984 | Tremmel . | |
| 4,483,711 | 11/1984 | Harbulak et al. . | |
| 4,549,942 | 10/1985 | Tremmel et al. . | |
| 4,666,786 | 5/1987 | Yano et al. . | |
| 4,677,817 | 7/1987 | Kanai . | |
| 4,698,958 | 10/1987 | Nakano et al. | 57/119 |
| 4,814,205 | 3/1989 | Arcilesi et al. . | |
| 4,868,066 | 9/1989 | Whitmore . | |
| 4,885,905 | 12/1989 | Maruta et al. . | |
| 5,086,615 | 2/1992 | Bodnar | 57/75 X |

FOREIGN PATENT DOCUMENTS

| | | | |
|---|---|---|---|
| 3836670 | 7/1989 | Fed. Rep. of Germany . | |
| 106634 | 8/1979 | Japan | 57/120 |
| 20366 | 5/1981 | Japan | 57/125 |
| 35489 | 8/1987 | Japan | 57/125 |
| 2177239 | 8/1987 | Japan | 57/125 |
| 3270819 | 11/1988 | Japan | 57/125 |

OTHER PUBLICATIONS

*The Journal of Textile Institute,* vol. XXIII, No. 12, 1932 by Donald Eadie.

*Primary Examiner*—Daniel P. Stodola
*Assistant Examiner*—William Stryjewski
*Attorney, Agent, or Firm*—Dority & Manning

[57] ABSTRACT

A composition for coating rings or travelers employed in yarn spinning applications is provided. The particular composition comprises an iron replacement composition such as copper selenide. The coating may be applied to rings and travelers in thicknesses of from about 0.001 mils to about 0.05 mils. The coating provides a low friction but high wear resistant surface between the traveler and a ring.

12 Claims, 2 Drawing Sheets

COATINGS FOR SPINNING APPLICATIONS AND RINGS AND TRAVELERS COATED THEREWITH

FIELD OF THE INVENTION

The present invention relates generally to a coating for travelers and rings used in textile applications, such as yarn spinning, and more specifically to travelers and rings having a low friction, wear resistant surface thereon.

BACKGROUND OF THE INVENTION

In conventional spinning and twisting operations, a plurality of spindles are arranged in a row on a frame beneath a vertically reciprocated rail. The rail supports a plurality of twister or traveler rings, one for each spindle, with the rings being arranged to be reciprocated with the rail along the length of the spindle associated with the particular ring. A small, lightweight traveler or guide is arranged to freely move about the ring. The traveler rotates about the spindle so that a body of fibers, filaments, yarn, or the like may be engaged by the traveler as the fibers are fed from drafting rolls and are wound on a bobbin supported on the twisting spindle. The travelers generally have an intermediate portion and horns defining a gap therebetween for slidable mounting on a flange of the spinning ring.

The limiting factor with respect to increased spinning speeds is the wear force between the traveler and the ring. As the textile industry moves to higher spinning speeds, traveler speeds also increase. As spinning speeds increase, both tension, which is the force exerted by the yarn on the traveler, and friction, which is the force that opposes relative motion between the yarn and the traveler and between the traveler and the ring, increase.

Collateral to the problems of wear resistance are those of lubricity. As the polished surfaces of the traveler wear down, they become roughened and increase the coefficient of friction between the traveler and the ring, resulting in increased friction and potential heat build-up. It is not uncommon for the horns of travelers to burn off which, in addition to loss of production time for replacement of the traveler, can cause damage to the yarn and the ring.

In addition to heat build-up, a roughened traveler will fray and eventually break the yarn, causing lost production time and a low quality end product. Such roughened travelers tend to become loaded with excess fibers which cause the travelers to require cleaning or replacement.

Conventional travelers are generally made of hardened steel wire and, of course, contain iron. Travelers are usually finished with a variety of coatings including nickel plates, oxidation finishes, ceramics, and teflon composites. Each of the coatings attempts to solve problems of corrosion resistance or wear resistance. The present finishes, however, are insufficient to resolve all the problems associated with the wear of travelers and rings used in high speed spinning operations.

For example, nickel platings often cause a transfer of material to the ring which, in turn, results in accelerated traveler wear after the nickel plating is initially penetrated. Oxidation finishes cause a softening or tempering of the hardened steel during application thereof. Ceramic finishes also soften the steel surfaces, allowing for severe wear on conventional rings. Teflon composites, while offering various advantageous, can exhibit problems similar to those associated with nickel plated coatings in that they tend to wear off quickly, leaving bear surfaces subject to additional wear.

During the initial break-in process of conforming the traveler to the ring surface, a minor amount of traveler material must be removed. Such seating action is necessary for heat conduction and lowering of contact stress. Wear of the ring and/or traveler is accelerated if removal of this material damages the ring surface or deposits abrasive materials thereon.

To decrease wear and friction, various oil-based lubricants such as those described in U.S. Pat. No. 3,304,710 to Kluttz have been employed for lubricating the ring in traveler assemblies. Moreover, various electroless plating methods such as those discussed in U.S. Pat. No. 3,226,924 to Dalpiaz have also been utilized to apply various coatings to travelers and rings.

An alternative approach to the problems of lubricity and wear has been to provide polymeric, rather than metallic, rings and travelers that inherently allow for a lower coefficient of friction. Plastic travelers have the added advantage of being lightweight. Such lightweight travelers have not yet proven themselves in high speed spinning operations.

Plastic parts, however, are poor conductors of heat and have relatively low softening points. In the case of metal rings and travelers, friction therebetween develops heat which is rapidly conducted away from the traveler. Because of the poor conductibility of plastic, heat poses a major problem to plastic parts. U.S. Pat. No. 3,387,447 to, Trammell et al. addresses this problem by adding particles of conducting material such as bronze, copper or graphite to the plastic rings. However, it is generally known that such plastic parts, particularly plastic travelers, are only suitable for use with the heaviest yarns.

Although various coatings and lubricants for rings and travelers are known, the particular features of the present invention are absent from the art. The prior art is generally deficient in affording a high wear, low friction coating that may be applied to rings and travelers. The present invention overcomes the shortcomings of the prior art in that the coating composition disclosed herein results in travelers and rings having sufficient wear resistance for high speed spinning applications while at the same time providing low friction surfaces.

SUMMARY OF THE INVENTION

It is an object of the present invention to provide a composition for coating travelers and rings for use in textile spinning applications.

It is an object of the present invention to provide a traveler and ring coated with a composition that results in a traveler or ring surface having sufficient wear resistance for high speed spinning and twisting operations.

It is another object of the present invention to provide a coating for rings and travelers that will not soften the ring or traveler to which it is applied.

It is further another object of the present invention to provide coatings for travelers and rings to produce a low friction surface thereabout.

It is another object of the present invention to provide a coating whose thickness around rings and travelers is self-controlled during the coating process.

It is another object of the present invention to provide rings and travelers with a black surface coating for enhanced heat dissipation to prevent traveler and ring burning.

It is still further another object of the present invention to provide a coating for rings and travelers that allows wear in the yarn contact area to promote traveler seating without harming the ring surface or depositing material on the ring that may be detrimental to traveler or ring wear resistance.

It is yet another object of the present invention to provide rings and travelers for spinning and twisting having a coating thereon that provides for reduced friction therebetween.

Generally speaking, these as well as other objects of the present invention are achieved by providing a composition for coating travelers and rings comprising copper selenide. The copper selenide coating may be applied to either the travelers or the rings used in yarn spinning applications. Broadly speaking, the coating is chemically deposited on the ring or traveler and has a uniform thickness about the surface thereof in the range of from about 0.001 mils to about 0.05 mils, with a thickness of about 0.03 mils being preferred.

BRIEF DESCRIPTION OF THE DRAWINGS

A full and enabling disclosure of the present invention to one of ordinary skill in the art, including the best mode thereof, is set forth more particularly in the remainder of the specification with reference to the accompanying Figures, in which.

Figure 1:
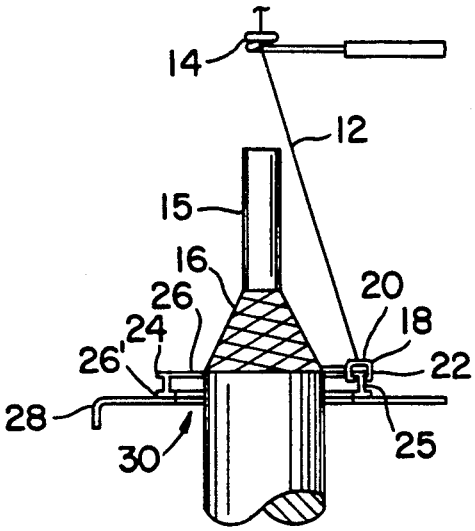
FIG. 1 is a side view of a spinning frame having a spinning ring and traveler in accordance with the present invention.

Repeat use of reference characters in the present specification and drawings is intended to represent the same or analogous features or elements of the invention.

DESCRIPTION OF PREFERRED EMBODIMENTS

The present invention is directed to rings and travelers for use in textile applications such as spinning, twisting, and the like, which require the winding of yarn onto a rotating carrier. The invention encompasses both vertical and horizontal rings, including reversible and non-reversible (single-flanged) horizontal rings. Similarly, all types and shapes of travelers suitable for use on such rings to guide yarn onto rotating carriers are within the scope of the present invention, including elliptical-shaped, "C"-shaped, and vertical travelers as described in U.S. Pat. No. 5,086,615 to Bodnar which is incorporated herein by reference in its entirety. Generally, the rotating carrier for winding yarn thereon is a bobbin fixedly mounted to a rotating spindle.

Referring more specifically to the drawings, a spinning frame has yarn 12 fed from drafting rolls (not shown) through guide 14 for winding onto a bobbin 16 which is mounted about and driven by rotating spindle 15. A traveler 18 having an intermediate portion 20 and inturned horns 22 defining a gap therebetween is slidably mounted on a spinning ring 24.

Figure 3:
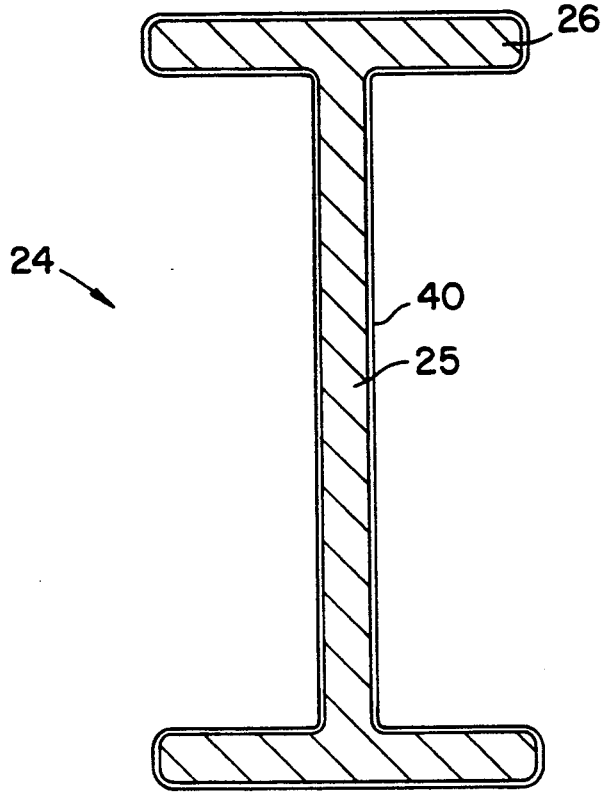
FIG. 3 is a cross-sectional view of the ring of FIG. 2 taken along line 3—3.

As shown in FIG. 3, the ring includes an intermediate vertical portion 25 and a first flange 26 for supporting traveler 18. The particular ring 24 shown herein is reversible, having a second flange 26 which provides an additional means for mounting the ring to the ring rail 28 such as by a snap fit. The ring rail defines an opening 30 about which the ring is fixedly mounted and which is further concentrically disposed about bobbin 16.

During spinning, yarn 12 is fed through guide 14 and threaded through traveler 18 for winding onto bobbin 16. Traveler 18 serves to tension and guide the yarn as it is wound onto bobbin 16. Ring rail 28 provides a vertically reciprocating "building motion" which further guides yarn 12 as it is wound onto bobbin 16.

Figure 2:
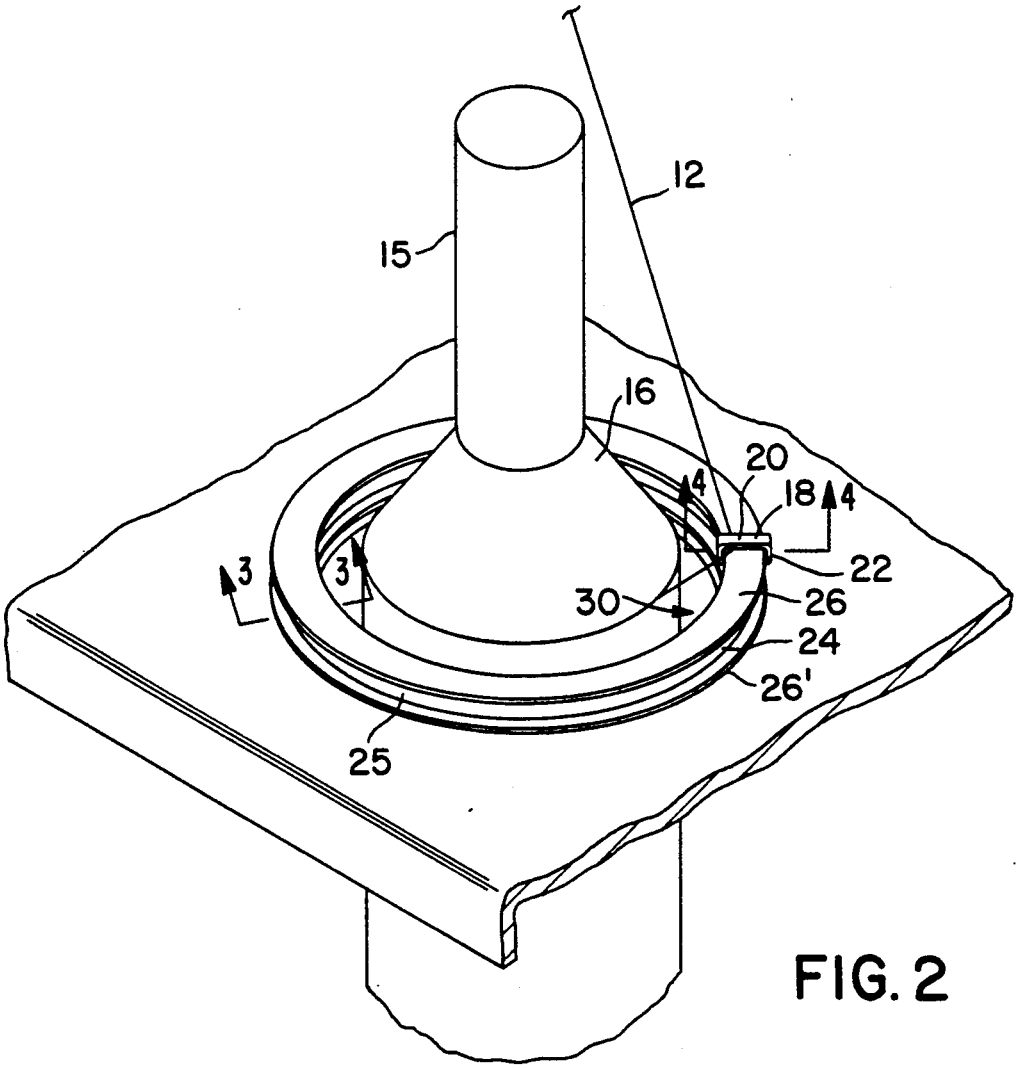
FIG. 2 is a perspective view of a spinning ring and traveler in accordance with the present invention having yarn threaded through the traveler for winding onto a rotating spindle.

The tensioning function of traveler 18 of the herein described ring and traveler system is best illustrated in FIG. 2. Generally, although traveler 18 slides freely about the flange of ring 24, traveler 18 drags behind the rotation of spindle 15 such that a tensioning force is imparted to the yarn as it is wound about the spindle.

Figure 4:
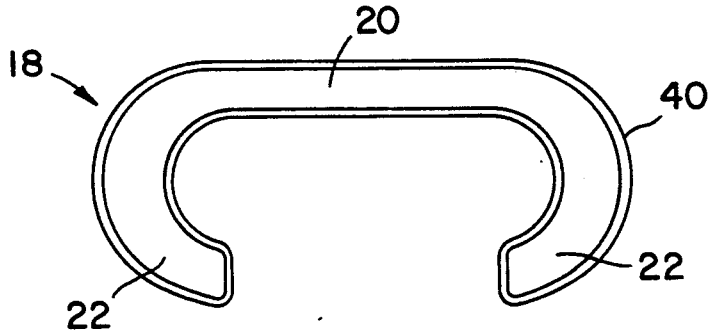
FIG. 4 is a cross-sectional view of the traveler of FIG. 2 taken along line 4—4.

As shown in FIGS. 3 and 4, each of the ring and traveler has a generally uniformly deposited coating 40 about the surface thereof. In the present invention, both the traveler and ring may be coated, or either of the traveler or ring may be coated.

The preferred coating is a chemically deposited composition comprising copper selenide. Preferably, the traveler and/or ring is coated to a thickness ranging from about 0.001 mil to about 0.05 mil (0.000001 inch to 0.00005 inch). It is to be understood, however, that FIGS. 3 and 4 are not drawn to scale but are presented for illustrative purposes only.

It is to be understood that all types of travelers and rings may be coated in accordance with the present invention, especially travelers and rings made of materials capable of undergoing a replacement reaction with the particular coating described herein. The coating preferred for use in the present invention is generally known as an iron replacement coating. In other words, the copper in the particular copper selenide coating described herein replaces iron found in travelers and/or rings. Although only a copper selenide coating is specifically mentioned herein, other iron replacement coatings known to be equivalent to this particular coating are included within the scope of the present invention.

The coating provides resistance greater than that of conventional nickel-phosphorous coatings and of the other coatings described above. Reduced frictions are achieved at high spinning rates when a ring and traveler, where either is coated in accordance with the present invention, are used in combination.

Generally, the particular coating described herein comprises copper selenide. One particular commercially available coating that has proven especially suitable for use in the present invention is a copper selenide conversion coating sold by Birchwood Casey of Eden Prairie, Minn. under the tradename PRESTO BLACK PC10. Other coatings equivalent to this particular copper selenide conversion coating may, of course, also be employed in the present invention.

Rings and travelers may be coated in accordance with the present invention by submerging the particular spinning machine component to be coated in a bath containing approximately 10 percent by volume of a copper selenide coating. The remaining bath volume consists of water. The bath is held at room temperature for about 1 minute, or until a uniform color on the travelers or rings is achieved. The rings or travelers may then be dried and buffed in a harperizer with a mixture of granulated corn cobs and a dry waxy polishing material. Of course, the drying and buffing steps of the present invention are not necessary to produce the herein described coated rings and travelers.

The coating may be applied to the surface of the traveler or ring in thicknesses of from about 0.001 mils to about 0.05 mils. Preferably, the thickness is about 0.03 mils, or about 30 millionths of an inch. The coating may be chemically deposited thereon according to the method described above or by any equivalent method. During coating of the herein described composition, the thickness is actually self-controlled in that plating may continue until the iron contained in the particular spinning machine component, either a ring or traveler, can no longer be replaced by copper. In this manner, a self-controlled plating process occurs during coating to achieve the desired thin coating. Accordingly, plating time is not critical to the present invention and is actually self-determined by the amount of iron in the part to be replaced.

A series of wear resistance tests were performed on travelers having the present composition coated thereon. In each of the three tests, the coating of the present invention comprising the copper selenide conversion coating described above was coated onto travelers and compared to the wear of travelers having a conventional nickel-phosphorous plating coating. In each of the three tests, identical spinning machine speeds and conditions were employed for the nickel plated and the present inventive coating.

TEST NO. 1

In the first test, wear of travelers having the herein described copper selenide coating thereon as measured by weight loss, in grams lost per 50 travelers, was compared to weight loss of travelers having a conventional nickel plating thereon. In this initial wear test, a traveler designated as 7-1-X1Z HRW74C was used. The conventional nickel plating weight loss in grams for every 50 travelers was between 0.06 and 0.065 grams. For travelers coated with the present copper selenide coating, the weight loss for every 50 travelers was between 0.04 and 0.045 grams.

TEST NO. 2

The second test employed a traveler designated as 13-2-1 ½ IHRW with the conventional nickel plating finish and a like traveler having the presently described copper selenide coating thereon. Under similar conditions, the conventional nickel plated travelers exhibited a weight loss of about 0.35 grams for every 50 travelers, whereas the travelers coated with the copper selenide finish showed a weight loss of about 0.175 grams for every 50 travelers.

TEST NO. 3

In another test, travelers designated as 4/0-1-M38 ELWD were employed for comparing the copper selenide coating wear to the wear of a conventional nickel coating. After one week of running on a spinning machine, the conventional nickel plated travelers showed a weight loss of approximately 0.025 grams for 50 travelers as compared to a weight loss of between about 0.01 and 0.015 grams for travelers coated with the present copper selenide composition. After two weeks of running, the conventional nickel plated travelers showed a wear of approximately 0.05 grams for 50 travelers, whereas the present copper selenide-coated travelers showed a wear of between about 0.015 and 0.02 grams for every 50 travelers.

These particular tests indicate the relatively high wear resistance of the present inventive coating as compared to conventional nickel platings.

It will be understood that the invention is not limited to the particular composites or processes described herein, nor the particular parameters or dimensions described therefor. It should also be understood that any composition equivalent to that described falls within the scope of the present composition. Preparation routes of the coatings and process steps for application thereof are merely exemplary so as to enable one of ordinary skill in the art to employ the coatings and use them according to the present process. It will also be understood that while the form of the invention shown and described herein constitutes a preferred embodiment of the invention, this description is not intended to illustrate all possible forms of the invention. The words used are words of description rather than of limitation. Various changes and variations may be made to the present invention without departing from the spirit and scope of the following claims.

What is claimed is:

1. An improved traveler having high wear resistance and low friction characteristics for use on a ring in textile applications requiring winding of yarn onto rotating spindles, said ring defining at least one flange for receiving said traveler, said traveler having an intermediate portion and inturned horns defining a gap therebetween for sliding around said flange, said ring fixedly mounted to a ring rail and concentrically disposed about a rotating spindle having a bobbin mounted thereon for reciprocating vertically thereabout, said applications further having yarn fed from drafting rolls for threading through said traveler and winding onto said bobbin for tensioning and guiding said yarn onto said bobbin, the improvement comprising:

a coating on the surface of said traveler, said traveler being constructed of a metal capable of undergoing a replacement reaction and said coating comprising copper selenide chemically deposited on said traveler by a replacement reaction between copper and said metal.

2. The traveler as defined in claim 1 wherein said coating is substantially uniform about said surface of said traveler.

3. The traveler as defined in claim 2 wherein said coating thickness is about 0.03 mils.

4. The traveler as defined in claim 1 wherein said coating is substantially uniform, covers the entire surface of said traveler, and has a thickness of 0.001 mils to 0.05 mils.

5. The traveler as defined in claim 1, wherein said metal is iron.

6. An improved ring and traveler system having high wear resistance and low friction characteristics for use in textile applications requiring winding of yarn onto rotating spindles, said ring defining at least one flange for receiving said traveler, said traveler having an intermediate portion and inturned horns defining a gap therebetween for sliding around said flange, said ring being fixedly mounted to a ring rail and concentrically disposed about a rotating spindle having a bobbin mounted thereon for reciprocating vertically thereabout, said applications further having yarn fed from drafting rolls for threading through said traveler and winding onto said bobbin for tensioning and guiding said yarn onto said bobbin, the improvement comprising:

a coating on the surface of said traveler and said ring, said traveler being constructed of a first metal and said ring being constructed of a second metal wherein said first and second metals are capable of undergoing a replacement reaction, said coating comprising copper selenide chemically deposited on said traveler and said ring by a replacement reaction between copper and said respective first and second metals.

7. The ring and traveler system as defined in claim 6 wherein said coatings are substantially uniform and have a thickness of from 0.001 mils to 0.05 mils.

8. The ring and traveler system as defined in claim 6, wherein said first and said second metals are iron.

9. An improved ring having high wear resistance and low friction characteristics for use in textile applications requiring winding of yarn onto rotating spindles, said ring defining at least one flange for receiving said traveler, said traveler having an intermediate portion and inturned horns defining a gap therebetween for sliding around said flange, said ring fixedly mounted to a ring rail and concentrically disposed about a rotating spindle having a bobbin mounted thereon for reciprocating vertically thereabout, said applications further having yarn fed from drafting rolls for threading through said traveler and winding onto said bobbin for tensioning and guiding said yarn onto said bobbin, the improvement comprising:

a coating on the surface of said ring, said ring being constructed of a metal capable of undergoing a replacement reaction and said coating comprising copper selenide chemically deposited thereon by a replacement reaction between copper and said metal.

10. The ring as defined in claim 9 wherein said coating is substantially uniform about said ring and has a thickness of from 0.001 mils to 0.05 mils.

11. The ring as defined in claim 9, wherein said metal is iron.

12. An improved traveler having high wear resistance and low friction characteristics for use in textile applications requiring winding of yarn onto rotating spindles, said ring defining at least one flange for receiving said traveler, said traveler having an intermediate portion and inturned horns defining a gap therebetween for sliding around said flange, said ring fixedly mounted to a ring rail and concentrically disposed about a rotating spindle having a bobbin mounted thereon for reciprocating vertically thereabout, said applications further having yarn fed from drafting rolls for threading through said traveler and winding onto said bobbin for tensioning and guiding said yarn onto said bobbin, the improvement comprising:

a substantially uniform coating on the surface of said traveler said traveler contains iron and said coating comprising copper selenide chemically deposited thereon by a replacement reaction between copper and said iron, said coating covering the entire surface of said traveler and said coating having a thickness of about 0.03 mils.

* * * * *